US006058580A

United States Patent [19]

Shih

[11] Patent Number: 6,058,580

[45] Date of Patent: May 9, 2000

[54] STRUCTURAL IMPROVEMENT OF CLOTHES HANGER CLASP

[76] Inventor: Chin Fon Shih, No. 21, Lane 166, Chun Ying St., Shu Lin Town, Taipei County, Taiwan

[21] Appl. No.: 09/253,043

[22] Filed: Feb. 19, 1999

[51] Int. Cl.[7] ..... A44B 21/00; A47G 25/00

[52] U.S. Cl. ..... 24/511; 24/501; 24/542; 24/545; 24/563

[58] Field of Search ..... 24/511, 501, 542, 24/545, 562, 563, 573.1

[56] References Cited

U.S. PATENT DOCUMENTS

| | | | |
|---|---|---|---|
| 1,675,286 | 6/1928 | Van Valkenburg | 24/563 |
| 2,523,780 | 9/1950 | Rodriguez | 24/562 |
| 2,593,201 | 4/1952 | Saunders | 24/501 |
| 4,716,634 | 1/1988 | Fan | 24/501 |
| 5,075,935 | 12/1991 | Abdi | 24/511 |
| 5,082,153 | 1/1992 | Duester et al. | 24/545 |
| 5,199,140 | 4/1993 | Valiulis et al. | 24/542 |
| 5,639,049 | 6/1997 | Jennings et al. | 24/563 |

*Primary Examiner*—Victor N. Sakran
*Attorney, Agent, or Firm*—Bacon & Thomas

[57] ABSTRACT

A clothes hanger clasp, particularly to a clothes hanger clasp that will not easily fall off but can be loosened in a convenient way, includes a metal plate roughly in a "U" shape, where the metal plate is divided into an upper clasp plate and a lower clasp plate that are somewhat curled inwardly. On the upper clasp plate is a protruding part and a force applying mechanism that is curled inwardly. The protruding will enable stronger elasticity to for clothes hanger clasp, and, acting with the upper and lower metal clasp plates, it will tightly clasp onto the clothes hanger. The force applying mechanism facilitates easy application of force to loosen the hanger clasp, and it is designed so that the hanger clasp will not fall off easily, but it can be loosened in a convenient way.

6 Claims, 6 Drawing Sheets

STRUCTURAL IMPROVEMENT OF CLOTHES HANGER CLASP

BACKGROUND OF THE INVENTION

The subject invention relates to a structural improvement of a clothes hanger clasp, particularly to one that will not easily fall off but can be conveniently loosened.

Conventionally, to air out clothes after they are washed, a hanger 1 is used to hang the clothes. The clothes will be stretched by the hanger 1 to enable air flow or sunlight to radiate through the fabrics, to dry the clothes, or to display the clothes. Such a hanger 1 (refer to FIG. 1) requires merely a single piece of iron wire that is shaped to hang some clothes, but when the size of the clothes is larger, the hanger 1 will not be large enough to hang the clothes.

A metal plate, bent roughly in the shape of a "U" to serve as a hanger clasp 3 (refer to FIG. 3), was later is installed a, on the hanger 1 was improved to become a hanger 2 (refer to FIG. 2) with a hanger clasp 3 to fasten the clothes. Such a mechanism, however, involves the following shortcomings:

1. By means of metal elasticity and a clasping mechanism, it will hold the clothes, but due to its insufficient elasticity, the clothes will easily fall off.

2. The user will find it difficult to loosen the clasp when he wants to remove the clothes, since there is no way of applying force to the clasp 3.

In view of the above, the inventor has come up with the subject invention, based on several years of experience in related design and production, that will effectively redress the shortcomings of conventional types of clothes hanger clasps.

SUMMARY OF THE INVENTION

The primary objective of the subject invention is to present an improved structure of clothes hanger clasp that will effectively keep the clothes from falling off.

The secondary objective of the subject invention is to provide an improved structure of clothes hanger clasp that can be conveniently loosened.

To enable better understanding of the technique, principles and performance of the subject invention, a preferred embodiment is described with drawings.

DETAILED DESCRIPTION OF PREFERRED EMBODIMENT

Figure 1:
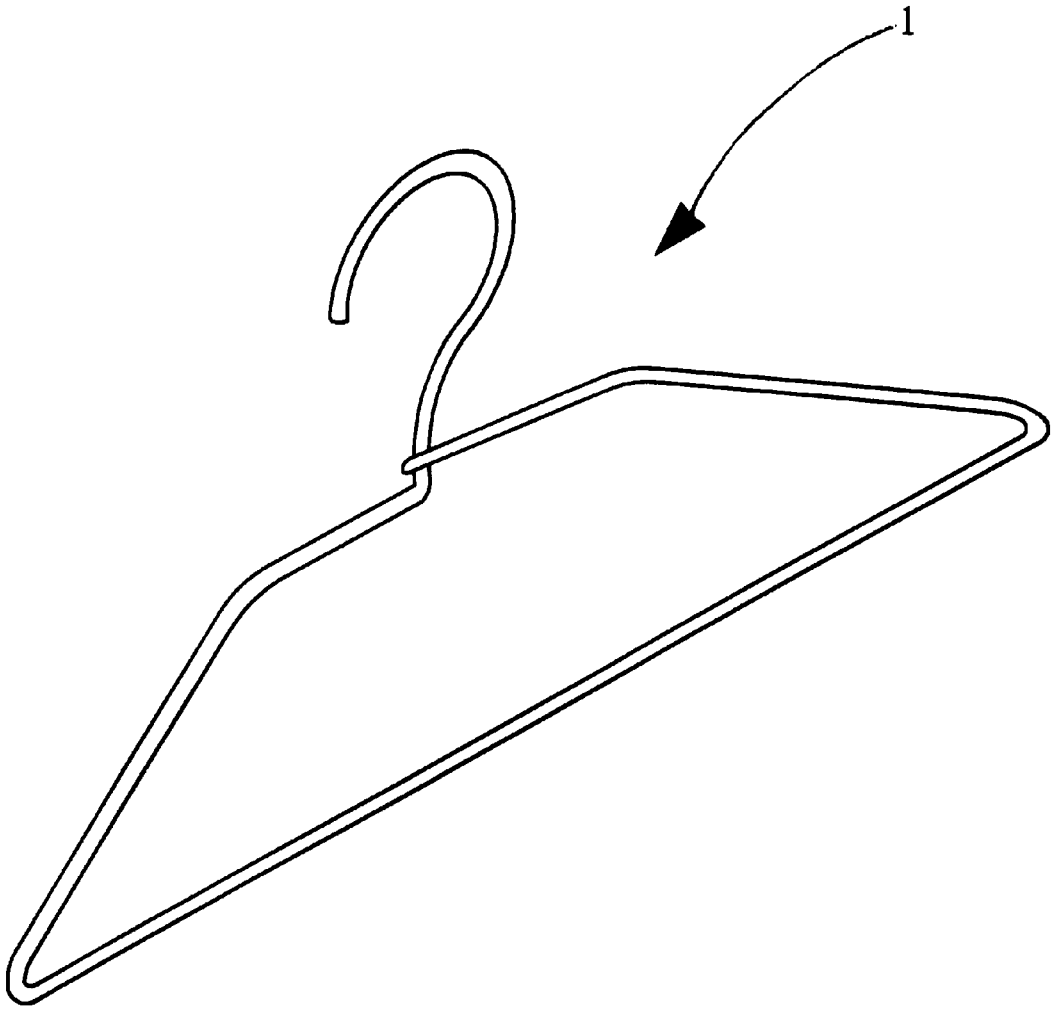
FIG. 1 PRIOR ART
FIG. 1 is a perspective view of a prior art of clothes hanger.
Figure 2:
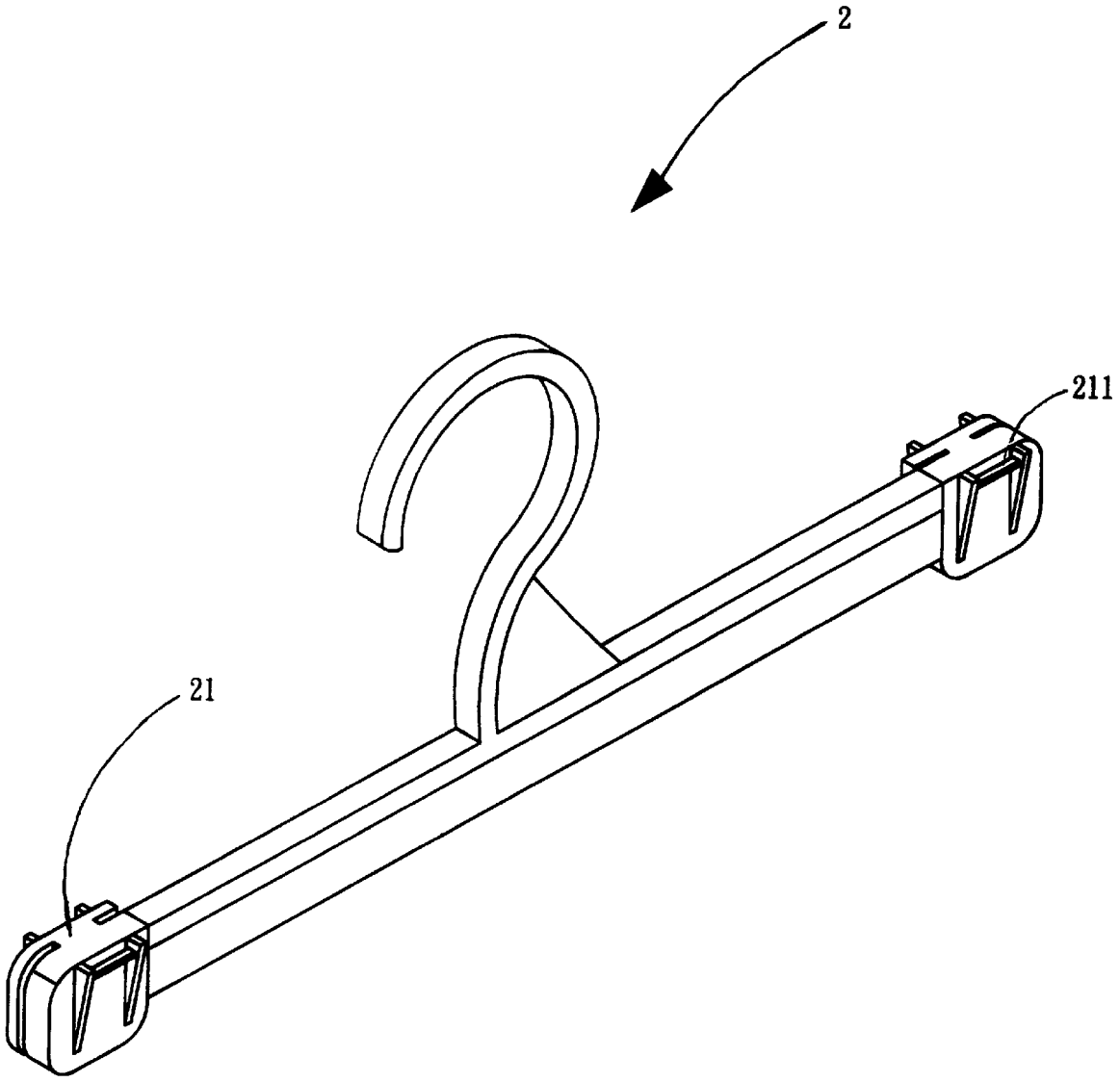
FIG. 2 PRIOR ART
FIG. 2 is a perspective view of an improved type of clothes hanger.
Figure 3:
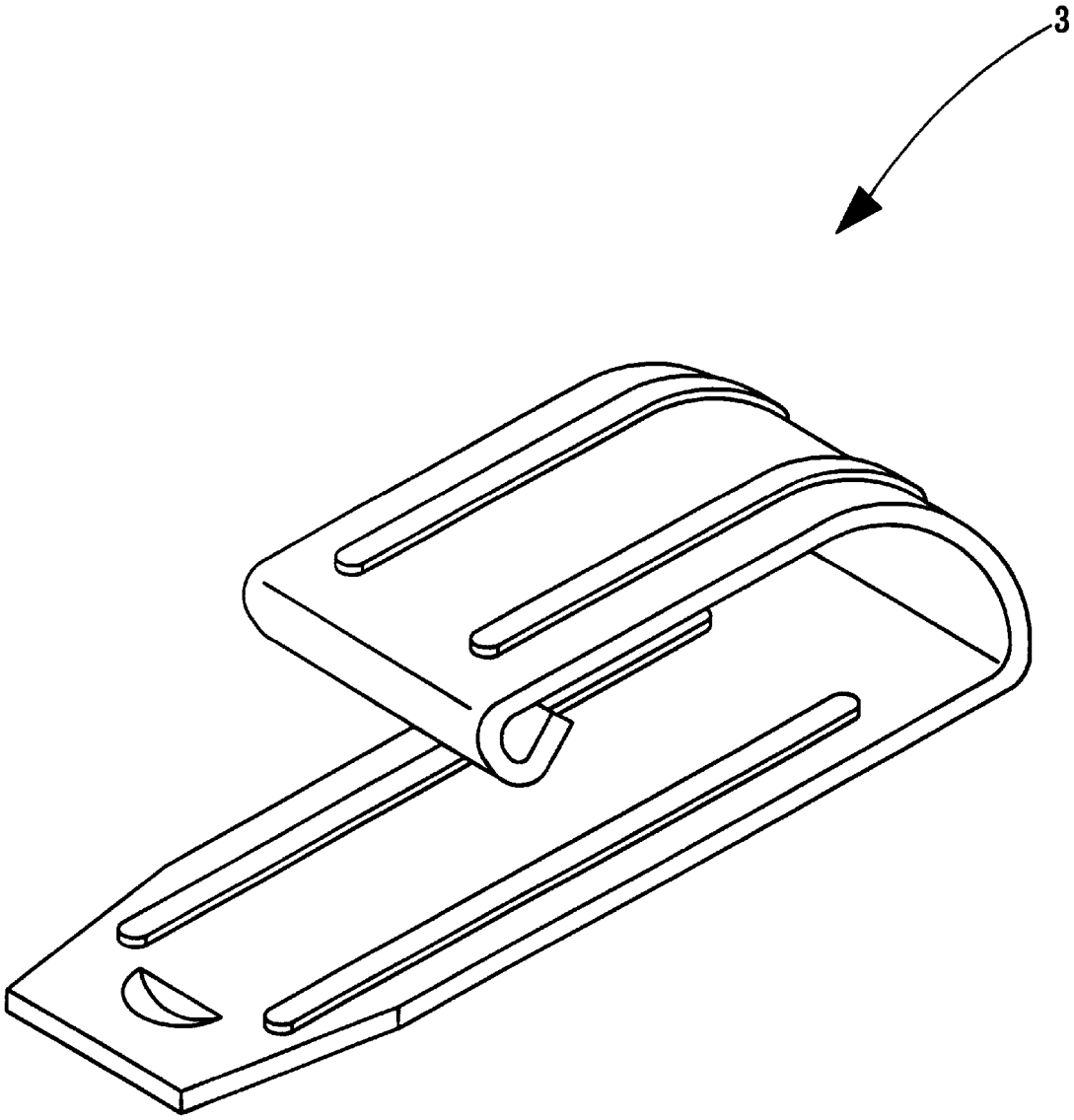
FIG. 3 PRIOR ART
FIG. 3 is a perspective view of a prior art of clothes hanger.
Figure 4:
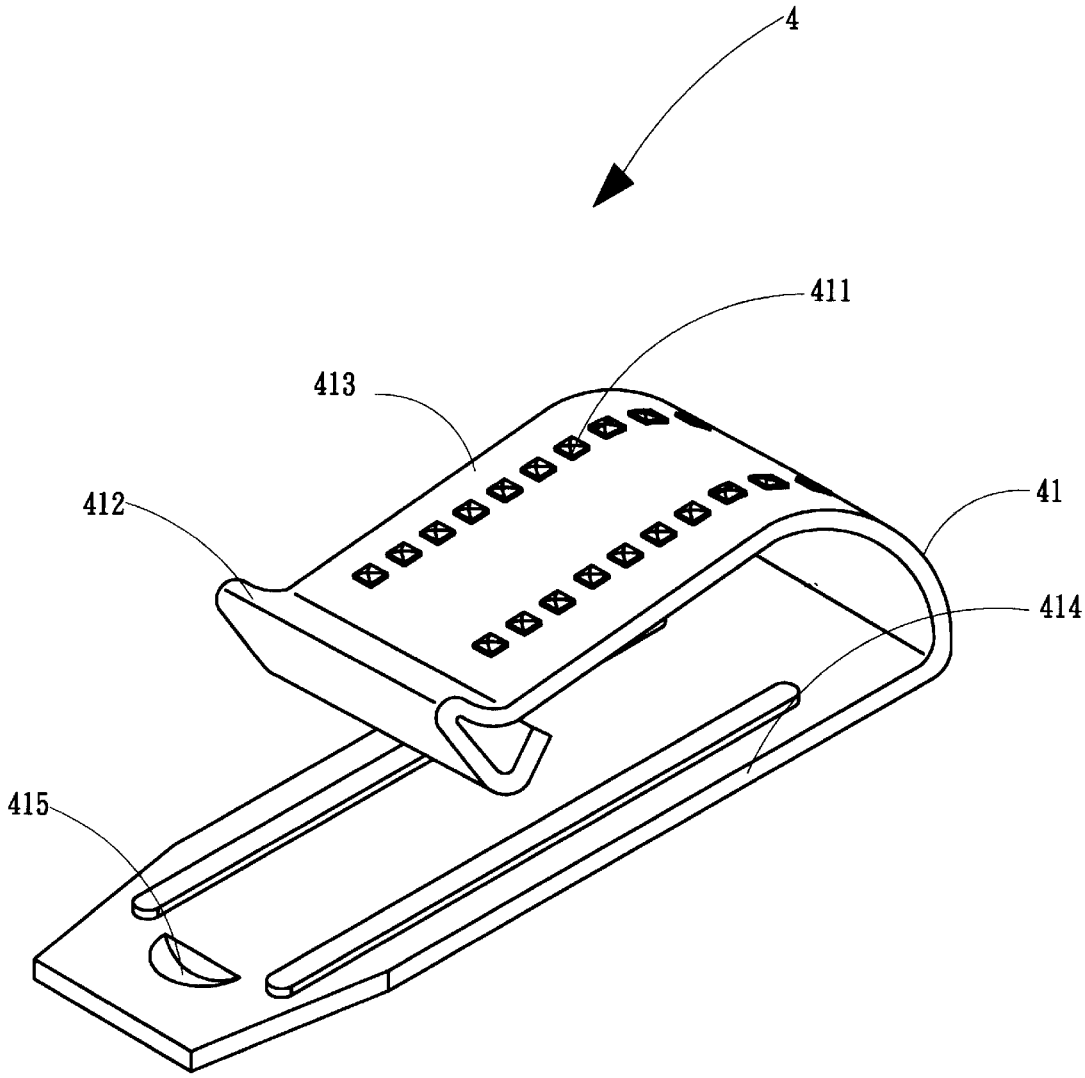
FIG. 4 is a perspective view of the invention.

FIG. 4 illustrates the subject invention of clothes hanger clasp 4 comprising a U-shaped metal plate 41, said metal plate 41 is composed of an uper clasp plate 413 and a lower clasp plate 414, said upper clasp plate 413 and said lower clasp plate 414 are somewhat curled inwardly opposed clasping elements of, on each of the left and right sides of said upper clasp plate 413 is a row of protruding juts 411, at the clasp end of said upper clasp plate 413 is a force applying mechanism 412 that is curled inwardly and somewhat upwardly, and near the clasp end of said lower clasp plate 414 is a stop part 415.

Figure 5:
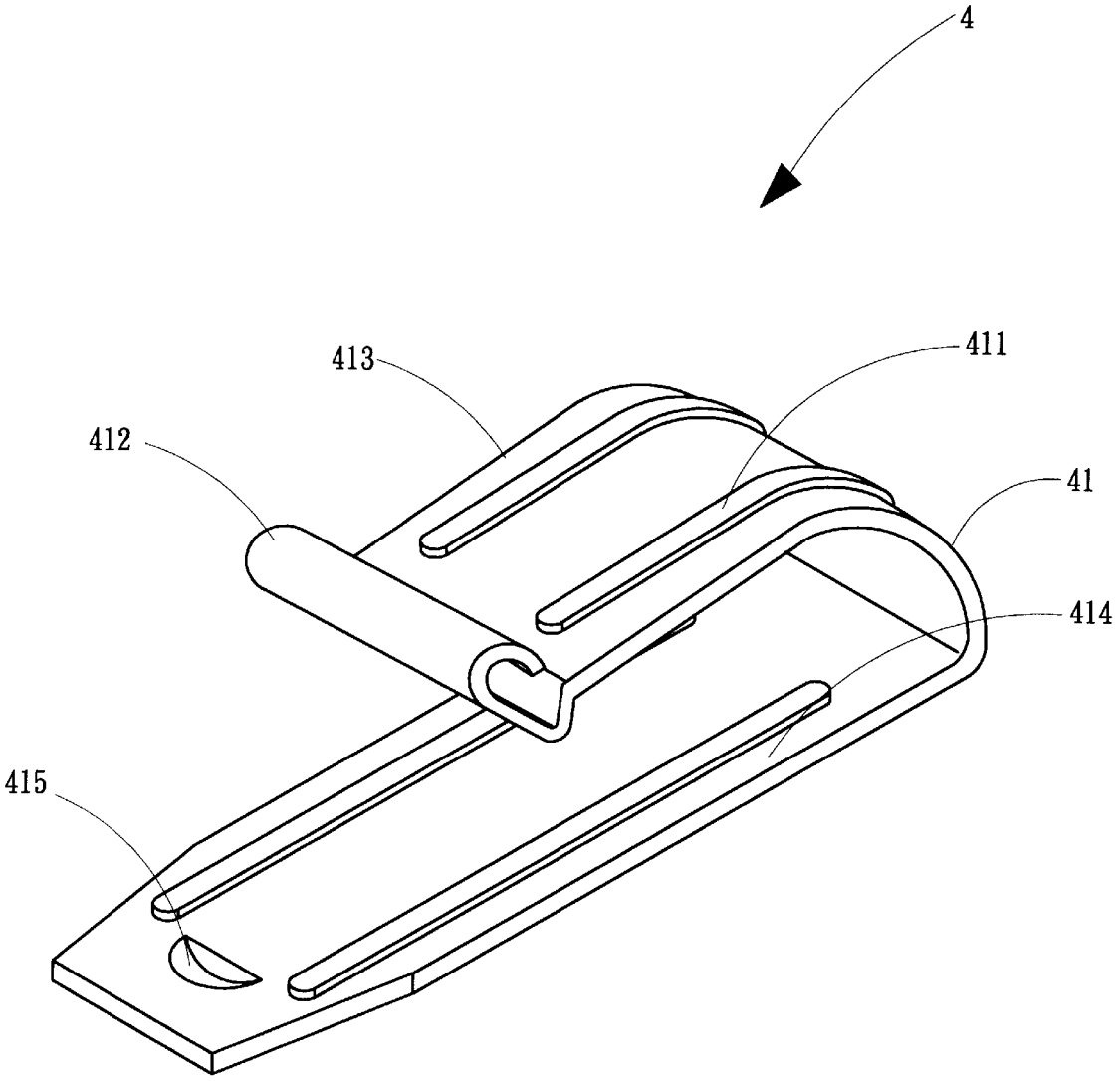
FIG. 5 is a perspective view of another embodiment of the invention.

Referring to FIG. 5, the force applying mechanism 412 that is curled inwardly and somewhat upwardly at the clasp end of said upper clasp plate 413 can also be designed to curl outwardly.

Figure 6:
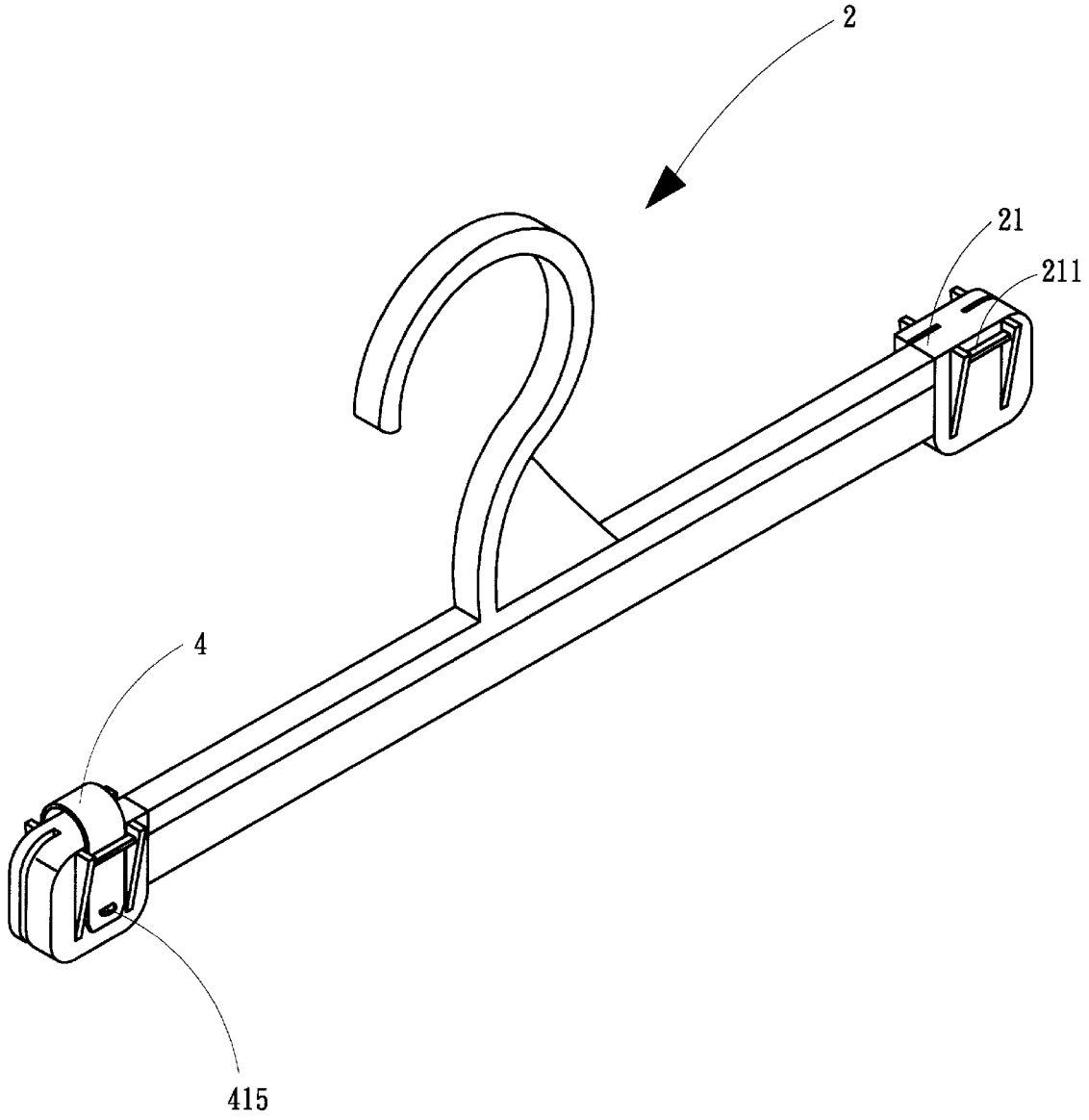
FIG. 6 is a view of the invention in application.

Referring to FIG. 6 (and FIG. 4 simultaneously), the lower clasp plate 414 of the subject invention of clothes hanger clasp 4 is inserted into the stop strip 211 on an improved type of clothes hanger, wherein the upper clasp plate 413 acts with the lower clasp plate 414 to fasten the opposed clasping elements of clasping device 21 of the clothes hanger 2, and since the upper clasp plate 413 and the lower clasp plate 414 are somewhat curled inwardly, a stronger clasping force is exerted on the clasping device 21 of the clothes hanger 2 by clasp 4 to fasten clothes to the hanger 2. The, the stop part 415 on the hanger clasp 4 and the stop strip 211 on the clothes hanger 2 act mutually to obstruct the hanger clasp 4, so that the hanger clasp 4 cannot escape or break free from the clothes hanger 2, and the protruding juts 412 on the hanger clasp 4 will reinforce the elasticity of the hanger clasp 4, so that when the hanger clasp 4 is fastened the clasping device 21 of the clothes hanger 2, it will not fall off. The force applying mechanism 412 is so designed that a user's finger will be able to apply force to loosen the hanger clasp 4, to avoid difficulty in loosening the hanger clasp 4.

Summing up, the advantages of the subject invention of hanger clasp include:

1. Elasticity of the hanger clasp is reinforced due to the installation of the protruded juts.

2. Since the upper clasp plate and the lower clasp plate are curled somewhat inwardly, the clasp part of the clothes hanger will have a stronger clasping force to fasten.

3. Due to the additional force applying mechanism, force can be easily applied to loosen the clothes hanger clasp.

The above description relates merely to a preferred embodiment which shall not be based to restrict or limit the scope of application of the subject invention, and that all equivalent variations or modifications deriving from the subject invention shall be included in the subject claims.

I claim:

1. In a clothes hanger including at least one closed clasping device formed as a pair of closeable clamping elements connected to each other at one end thereof and a resilient force applying member movably slidable over the clamping elements across their connected ends, said force applying element formed as a single piece, U-shaped sheet metal element and having a curved closed end connected to opposed upper and lower longitudinally extending clasp plates arranged to slidably engage the clamping elements to press them together when moved longitudinally to a clasping position and to release them for opening motion when moved to an opposite released position, the improvement comprising:

said upper clasp plate bent so that it approaches but does not engage said lower clasp plate, and terminating at a curled over edge that includes a portion that first extends away from the lower clasp plate, then extends directly towards the lower clasp plate, then extends inwardly and under itself towards the closed end of the U-shaped sheet metal element;

said upper clasp plate also including a pair of laterally spaced apart aligned stiffener structures extending longitudinally along the upper clasp plate from a location located on the curved closed end of the U-shaped sheet metal element to a location adjacent the terminal end thereof;

said stiffener structures formed integrally of the same sheet material forming said U-shaped element to thereby stiffen the bending strength of said upper clasp plate;

said portion of the terminal end of said upper clasp plate extending directly toward the lower clasp plate providing a gripping edge for enabling manipulation of the force applying element from a clasping to a released position.

2. The improvement as claimed in claim 1, said stiffener structures comprising parallel protruding juts.

3. The improvement according to claim 2, said juts formed as discontinuous protrusions.

4. The improvement as claimed in claim 2, said juts formed as continuous protrusions.

5. In a clothes hanger including at least one closed clasping device formed as a pair of closeable clamping elements connected to each other at one end thereof and a resilient force applying member movably slidable over the clamping elements across their connected ends, said force applying element formed as a single piece, U-shaped sheet metal element and having a curved closed end connected to opposed upper and lower longitudinally extending clasp plates arranged to slidably engage the clamping elements to press them together when moved longitudinally to a clasping position and to release them for opening motion when moved to an opposite released position, the improvement comprising:

said upper clasp plate bent so that it approaches but does not engage said lower clasp plate, and terminating at a curled over edge that includes a first portion that first extends towards the lower clasp plate, then extends directly away from the lower clasp plate and then curls outwardly back over itself towards the closed end of the U-shaped element;

said upper clasp plate also including a pair of laterally spaced apart aligned stiffener structures extending longitudinally along the upper clasp plate from a location located on the curved closed end of the U-shaped sheet metal element to a location adjacent the terminal end thereof;

said stiffener structures formed integrally of the same sheet material forming said U-shaped element to thereby stiffen the bending strength of said upper clasp plate;

said portion of the terminal end of said upper clasp plate extending directly toward the lower clasp plate providing a gripping edge for enabling manipulation of the force applying element from a clasping to a released position.

6. The improvement as claimed in claim 5, wherein said stiffener structures comprise parallel protruding juts.

* * * * *